US006320284B1

(12) United States Patent
Fontana et al.

(10) Patent No.: US 6,320,284 B1
(45) Date of Patent: Nov. 20, 2001

(54) MOTOR ASSEMBLY ALLOWING OUTPUT IN MULTIPLE DEGREES OF FREEDOM

(75) Inventors: Richard Remo Fontana, Arlington; Christopher J. Corcoran, Woods Hole, both of MA (US)

(73) Assignee: Engineering Matters, Inc., Arlington, MA (US)

( * ) Notice: Subject to any disclaimer, the term of this patent is extended or adjusted under 35 U.S.C. 154(b) by 0 days.

(21) Appl. No.: 09/470,077

(22) Filed: Dec. 22, 1999

Related U.S. Application Data

(60) Provisional application No. 60/113,619, filed on Dec. 23, 1998.

(51) Int. Cl.[7] ..... G05G 9/047

(52) U.S. Cl. ..... 310/12; 341/27; 345/161; 74/471 XY

(58) Field of Search ..... 310/12, 15, 17; 341/20, 27; 345/156, 157, 161; 74/471

(56) References Cited

U.S. PATENT DOCUMENTS

| | | | |
|---|---|---|---|
| 4,161,726 | 7/1979 | Burson et al. | 340/365 R |
| 4,352,646 | 10/1982 | Laing et al. | 417/420 |
| 4,375,631 | 3/1983 | Goldberg | 338/128 |

(List continued on next page.)

FOREIGN PATENT DOCUMENTS

| | | | |
|---|---|---|---|
| 98/55828 | 12/1998 | (WO) | G01B/7/30 |

OTHER PUBLICATIONS

"Automated Adaptive Control of Display Characteristics Within Future Air Force Crew Stations" Haas et al Proc. of Amer. Control Conference 1998; vol. 1, Air Force Res. Lab., Wright Patterson AFB, OH, USA; pp. 450–452 (Month Unknown).

"Biodynamic and Spasticity Reduction in Joystick COntrol via Force Reflection" Repperger Sep. 1995; AD–A313 739, AL/CR–TR–1995–0152 Armstrong Laboratory, Air FOrce Material COmmand, Wright–Patterson Air Force Base, OH; pp. 1–23.

"A Test of Fitts' Law in Two DImensions with Head and Head Movement" RJagacinski et al AD–A133 347, AFAM-RL–TR–83/054 Wright Patterson Air Force Base, OH Jul. 1983; pp. 1–23.

(List continued on next page.)

*Primary Examiner*—Nicholas Ponomarenko
*Assistant Examiner*—Judson H. Jones
(74) *Attorney, Agent, or Firm*—Hayes, Soloway, Hennessey, Grossman & Hage, P.C.

(57) ABSTRACT

A motor allowing multiple degrees of output freedom. The motor includes a stator having an interior surface forming at least a portion of a sphere or curved surface and first and second substantially orthogonally positioned stator coils wound on the interior surface. A rotor is fixed to the output shaft and movably supported adjacent the stator with an air gap disposed between the rotor and the stator. The rotor includes a plurality of magnets disposed thereon and is movable along the interior surface in directions defining at least first and second degrees of freedom. Upon energization of the first stator coil, a first magnetic field is established to force at least a first one of the magnets and the rotor in a direction in the first degree of freedom. Upon energization of the second stator coil, a second magnetic field is established to force at least a second one of the magnets and the rotor in a direction in the second degree of freedom. There is also provided a method of providing force feedback to joystick handle in response to manipulation of the handle by a user. The method includes: providing a motor consistent with the invention for driving the joystick; sensing a position of the joystick; and energizing at least one of the coils based on the sensed position to establish the feedback force against at least a first one of the magnets and the rotor.

21 Claims, 5 Drawing Sheets

U.S. PATENT DOCUMENTS

| | | | | |
|---|---|---|---|---|
| 4,477,043 | | 10/1984 | Repperger | 244/223 |
| 4,533,827 | | 8/1985 | Fincher | 250/211 K |
| 4,590,339 | | 5/1986 | Scott-Jackson et al. | 200/6 A |
| 4,607,197 | * | 8/1986 | Conrad | 318/115 |
| 4,632,341 | | 12/1986 | Repperger et al. | 244/230 |
| 4,642,595 | | 2/1987 | Ruumpol | 336/135 |
| 4,739,241 | | 4/1988 | Vachtsevanos et al. | 318/800 |
| 4,763,034 | * | 8/1988 | Gamble | 310/181 |
| 4,842,607 | | 6/1989 | Repperger et al. | 523/24 |
| 4,855,704 | | 8/1989 | Betz | 336/132 |
| 4,945,367 | | 7/1990 | Blackshear | 354/81 |
| 5,044,956 | | 9/1991 | Behensky et al. | 434/45 |
| 5,062,594 | | 11/1991 | Repperger | 244/175 |
| 5,107,080 | | 4/1992 | Rosen | 200/6 A |
| 5,111,288 | | 5/1992 | Blackshear | 358/108 |
| 5,319,577 | | 6/1994 | Lee | 364/559 |
| 5,328,166 | | 7/1994 | Hokamura | 271/171 |
| 5,349,881 | | 9/1994 | Olorenshaw et al. | 74/471 |
| 5,402,049 | | 3/1995 | Lee et al. | 318/568.1 |
| 5,410,232 | | 4/1995 | Lee | 318/568.11 |
| 5,416,392 | | 5/1995 | Lee et al. | 318/568.1 |
| 5,421,694 | | 6/1995 | Baker et al. | 414/694 |
| 5,491,462 | | 2/1996 | Cecchi et al. | 338/128 |
| 5,503,040 | | 4/1996 | Wright | 74/471 |
| 5,589,854 | | 12/1996 | Tsai | 345/161 |
| 5,619,195 | | 4/1997 | Allen et al. | 341/20 |
| 5,643,087 | | 7/1997 | Marcus et al. | 463/38 |
| 5,689,670 | | 11/1997 | Luk | 395/383 |
| 5,691,898 | | 11/1997 | Rosenberg et al. | 345/190 |
| 5,703,604 | | 12/1997 | McCutchen | 345/8 |
| 5,709,219 | | 1/1998 | Chen et al. | 128/782 |
| 5,721,566 | | 2/1998 | Rosenberg et al. | 345/161 |
| 5,731,804 | | 3/1998 | Rosenberg | 345/156 |
| 5,734,373 | | 3/1998 | Rosenberg et al. | 345/161 |
| 5,739,811 | | 4/1998 | Rosenberg et al. | 345/156 |
| 5,767,839 | | 6/1998 | Rosenberg | 345/161 |
| 5,773,773 | | 6/1998 | McCauley et al. | 200/6 A |
| 5,805,140 | | 9/1998 | Rosenberg et al. | 345/161 |
| 5,805,308 | | 10/1998 | Rosenberg | 341/20 |
| 5,831,554 | | 11/1998 | Hedayat et al. | 341/20 |
| 5,831,596 | | 11/1998 | Marshal et al. | 345/161 |
| 5,903,456 | | 5/1999 | Schena et al. | 364/190 |
| 5,929,607 | | 7/1999 | Rosenberg et al. | 320/166 |
| 5,929,846 | | 7/1999 | Rossenberg et al. | 345/161 |
| 5,942,832 | | 8/1999 | Oudet | 310/254 |
| 5,969,520 | | 10/1999 | Schottler | 324/207.2 |

OTHER PUBLICATIONS

"A Study of Adaptive Stick COntroller in Human Interface Systems" Repperger et al Proc. Of Amer. Control Conference 1998; vol. 1, Air Force Base Res. Lab., Wright Patterson AFB, OH, USA pp. 453–455 (Month Unknown).

"Effects of Differenct COntrol Mechanism Upon Use of a Trainign Device" Schlehcter AD–A212 979, US Army, Fort Know, KY, Jul. 1989; pp. 1–18.

"Sim Aims High" Electronic Design, Penton Media, Hasbrouck Heights, NJ Aug. 23, 1999; p. 32B.

"Why the Pentagon is Often SLow to Pursue Promising New Weapons" Ricks Wall Street Journal; Oct. 12, 1999 p. 1–9.

"Urban Warfare: Where Immovation Hasnt' Helped" Ricks Wall Street Journal; Oct. 12, 1999 pp. 1–3.

* cited by examiner

MOTOR ASSEMBLY ALLOWING OUTPUT IN MULTIPLE DEGREES OF FREEDOM

This application claimed benefit of provisional application Ser. No. 60/11319 used Dec. 23 1998.

FIELD OF THE INVENTION

The present invention relates in general to a motor assembly, and in particular to motor assembly that provides an output in one or more degrees of freedom for use in joystick and other applications.

BACKGROUND OF THE INVENTION

Various motor designs providing multiple degrees of freedom are known in the art for use in a wide variety of applications. For example, multiple degrees of freedom in motor output are particularly useful in linear actuation and positioning applications. Another application in which such motors may be used is in joystick applications for real control of an associated apparatus, e.g., direct control of an aircraft, or for simulation apparatus control, e.g. video games, flight simulation, virtual reality simulation, etc. In these applications a control system may be provided for sensing a user's manipulation of a joystick, i.e., the motor output shaft, and providing a signal for controlling the application.

Many applications also require force or tactile ("haptic") feedback to the user. The need for the user to obtain realistic tactile information and experience tactile sensation is extensive in many kinds of simulation and other applications. For example, in medical/surgical simulations, the "feel" of a probe or scalpel simulator is important as the probe is moved within the simulated body. It would invaluable to a medical trainee to learn how an instrument moves within a body, how much force is required depending on the operation performed, the space available in a body to manipulate an instrument, etc. In simulations of vehicles or equipment, force feedback for controls such as a joystick can be necessary to realistically teach a user the force required to move the joystick when steering in specific situations, such as in a high acceleration environment of an aircraft. Alternatively, in a high acceleration vehicle environment, the force feedback can be used to counteract the effect of the acceleration induced forces on the hand and thus improve controllability and safety of the vehicle. In virtual world simulations where the user can manipulate objects, force feedback is necessary to realistically simulate physical objects; for example, if a user touches a pen to a table, the user should feel the impact of the pen on the table. An effective human/computer interface, such as a joystick, not only acts as an input device for tracking motion, but also as an output device for producing realistic tactile sensations. An interface that accurately responds to signals having fast changes and a broad range of frequencies as well as providing such signals accurately to a control system, is therefore desirable in these and other applications.

In addition, there is a desire to provide force feedback to users of computer systems in the entertainment industry. Joysticks and other interface devices can be used to provide force feedback to a user playing a video game or experiencing a simulation for entertainment purposes. Through such an interface device, a computer system can convey to the user the physical sensation of colliding into a wall, moving through a liquid, driving over a bumpy road, and other sensations. The user can thus experience an entire sensory dimension in the gaming experience that was previously absent. Force feedback interfaces can provide a whole new modality for human-computer interaction.

In typical multi-degree of freedom apparatuses that are capable of providing force feedback, there are several disadvantages. Generally conventional devices are cumbersome and complex mechanisms that are difficult and expensive to manufacture. In particular, the use of a transmission between the actuator motor and the joystick reduces the performance of the device and reduces the reliability and life of the device. Many transmission types can fail in a manner that renders the device unusable. For industrial and military applications, reliability and maintenance concerns are sometimes linked to the safety of personnel. If a force feedback device is not reliable or failsafe, then its use in these applications may be restricted or prevented even though the force feedback capability would enhance the performance and safety for that application.

In consumer markets, low-cost is highly desirable. For example, personal computers for the home consumer are becoming powerful and fast enough to provide force feedback to the typical mass-market consumer. A need is thus arising to be able to manufacture and market force feedback interfaces as cheaply and as efficiently as possible. The, cost, complexity, reliability, and size of a force feedback interface for home use should be practical enough to mass-produce the devices. In addition, aesthetic concerns such as compactness and operating noise level of a force feedback device are of concern in the home market. Since the prior art feedback interfaces are mainly addressed to specific applications in industry, most force feedback mechanisms are costly, large, heavy, have significant power requirements, and are difficult to program for applications. The prior art devices require high-speed control signals from a controlling computer for stability, which usually requires more expensive and complex electronics. In addition, the prior art devices are typically large and noisy. These factors provide many obstacles to the would-be manufacturer of force-feedback interfaces to the home computer market.

Accordingly, there is a need in the art for a reliable motor allowing output in multiple degrees of freedom and capable of providing force feedback that may be efficiently and cost-effectively produced.

SUMMARY OF THE INVENTION

The present invention is organized about the concept of providing a reliable and cost-efficient motor allowing multiple degrees of output freedom. In particular, a motor consistent with the invention may include: a stator having an interior surface forming at least a portion of a sphere or curved surface and first and second substantially orthogonally positioned stator coils wound on the interior surface; and a rotor fixed to the output shaft and movably supported adjacent the stator with an air gap disposed between the rotor and the stator, the rotor including one or a plurality of magnetic field generators disposed thereon and being for movable along the interior surface in directions defining at least first and second degrees of freedom. Upon energization of the first stator coil, a first magnetic field is established to force at least a first one of the magnets and the rotor in a direction in the first degree of freedom. Upon energization of the second stator coil, a second magnetic field is established to force at least a second one of the magnets and the rotor in a direction in the second degree of freedom. The first degree of freedom may be parallel to the second stator coil and the second degree of freedom may be parallel to the first stator coil.

The interior surface of the stator may be defined by a stator back iron comprising a ferromagnetic material. Each of the rotor magnets may also be arranged on a rotor back iron comprising a ferromagnetic material. The rotor magnets may be permanent magnets or electromagnets.

The rotor magnets may be arranged to form different sides of a parallelogram, with first and second ones of the magnets defining a first pair of parallel sides of the parallelogram parallel to the first stator coil, and third and fourth ones of the magnets defining a second pair of parallel sides of the parallelogram parallel to the second stator coil. The parallelogram defined by the magnets may be a square. Also, the first and third ones of the magnets may be advantageously configured with north poles disposed adjacent the stator coils, and the second and fourth ones of the magnets are configured with south poles disposed adjacent the stator coils.

The rotor may be supported adjacent the stator by a gimbal mechanism connected to the output shaft, e.g., a joystick handle, and supported on the stator. The gimbal mechanism may be configured to establish pivot points for the output shaft to allow motion of the rotor in the first and second degrees for freedom, the pivot points being substantially aligned with an equator of the sphere or curved surface.

According to the invention, there is also provided a method of providing force feedback to joystick handle in response to manipulation of the handle by a user. The method includes: providing a motor consistent with the invention with the joystick being the output shaft; sensing a position of the joystick; energizing at least one of the coils based on the position to establish a the feedback force against at least a first one of the magnets and the rotor.

BRIEF DESCRIPTION OF THE DRAWING

For a better understanding of the present invention, together with other objects, features and advantages, reference should be made to the following detailed description which should be read in conjunction with the following figures wherein like numerals represent like parts.

DETAILED DESCRIPTION OF THE INVENTION

Figure 1:
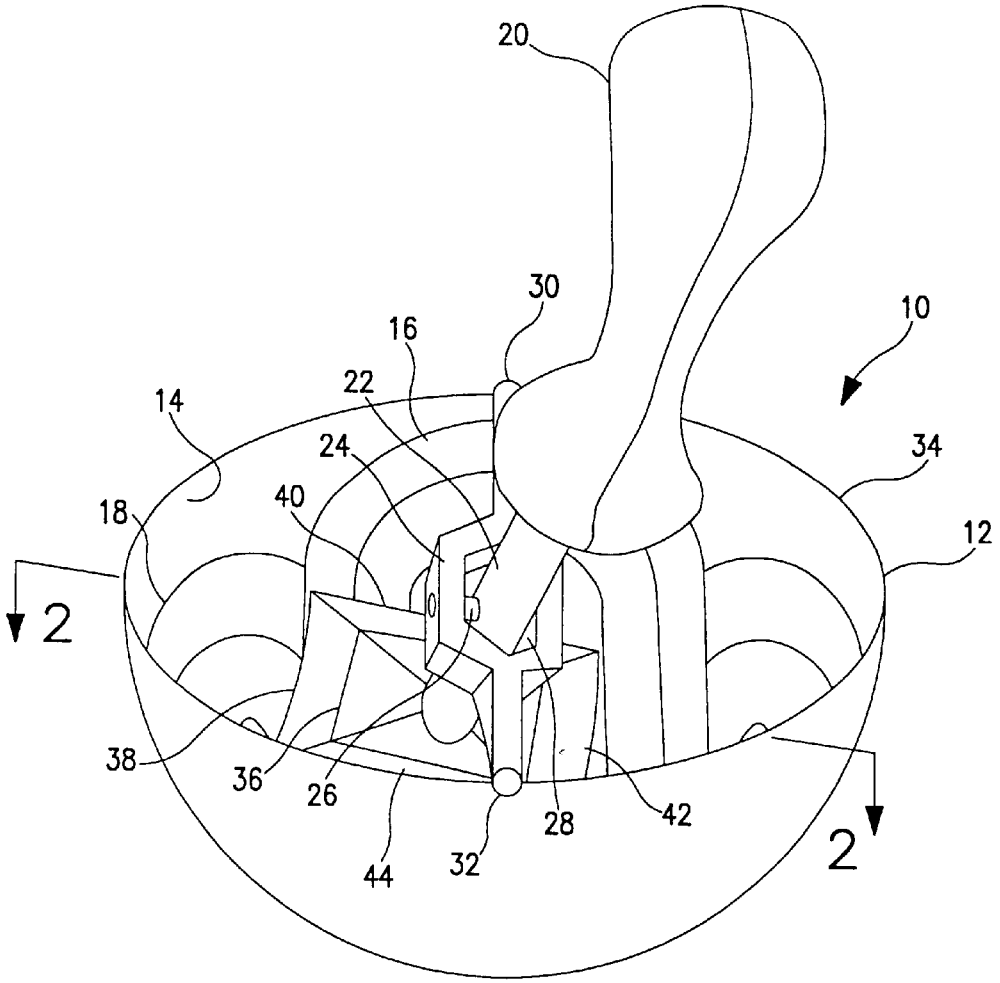
FIG. 1: is an isometric view of an exemplary embodiment of a motor assembly consistent with the invention in a joystick application.

With reference now to FIG. 1, there is shown an exemplary embodiment of a motor assembly 10 consistent with the invention. In the illustrated embodiment, the assembly 10 is configured for operation as a joystick, which may provide force feedback to a user through the joystick handle. It will be recognized by those skilled in the art, however, that a motor assembly 10 consistent with the invention may be used in a wide variety of applications. The descriptions provided herein relate to use of an assembly in a joystick configuration are provided, therefore, by way of illustration but not of limitation.

As shown, the exemplary embodiment of FIG. 1 generally includes a curved surface, hemisphere, or truncated sphere 12 of ferromagnetic material which will be simply referred to as the sphere for the purposes of discussion, but in reality may be nonspherical, which is lined on the interior 14 with coils 16 and 18 configured to carry electrical current provided from a power supply (not shown). In the illustrated embodiment the coils 16,18 are substantially orthogonal to each other. In a joystick application, as shown, a moving joystick handle 20 has a shaft 22 extending from a bottom thereof. The shaft 22 is attached to a bar 24 by a pivot 26 so that the shaft may pivot within an opening 28 in the bar 24 about the pivot 26. The bar 24 has first 30 and second 32 ends which are pivotally supported relative to the sphere, e.g. on an upper edge 34 of the sphere 12 as shown. A variety of means of constraining the rotor to move in the desired degrees of freedom will be known to those skilled in the art. The described system of constraint serves as a simple embodiment. It is to be understood, however, that a variety of means for constraining the moving components to the desired degrees of freedom will be known to those skilled in the art.

The bar thus acts as a gimbal, and the position of the shaft 22 can be sensed by sensing the rotation of the ends 32 or 30 and the pivot pin 26. A variety of means for sensing the rotational position of these elements, and therefore determining the position of the shaft 22 will be known to those skilled in the art for cost and simplicity considerations, however, it has been found that potentiometers may be coupled to the shafts to provide varying resistance depending on the position of the shaft. A control application can provide an output signal that varies according to the resistance provided by the potentiometers so that the output of the application is related in a known manner to the position of the shaft. It is to be understood, however, that a variety of means for providing shaft position information will be known to those skilled in the art.

The end of the shaft distal from the handle 20 has a ferromagnetic back iron 36 rigidly affixed thereto. The back iron 36 has one or a plurality of magnets affixed thereto. The magnets may be permanent magnets or electromagnets. In the illustrated embodiment the magnets 38, 40, 42 and 44 are arranged to form a square pattern with their edges substantially parallel with and perpendicular to the coils 16,18. Although the square configuration is preferable, it is possible to arrange the magnets in any parallelogram configuration.

The bar 24 and the pivot mechanism formed thereby maintains an air gap between the magnets 38,40,42,44, and the coils 16,18. Energization of one or more of the coils produces a force upon corresponding ones of the magnets in either of the two axes perpendicular to the wires in the coils. Advantageously, therefore, the coils may be selectively energized, e.g. in dependence of a control algorithm provided by a user application such as a video game or simulation device or based on the position of the joystick, to provide a force output to the user through the handle 20. Thus configured, the assembly 10 can be considered to include a stator defined by the coils on the sphere (or curved surface) 12 and a rotor defined by the magnets 38, 40, 42 and 44 positioned on the end of the shaft 22.

Figure 2:
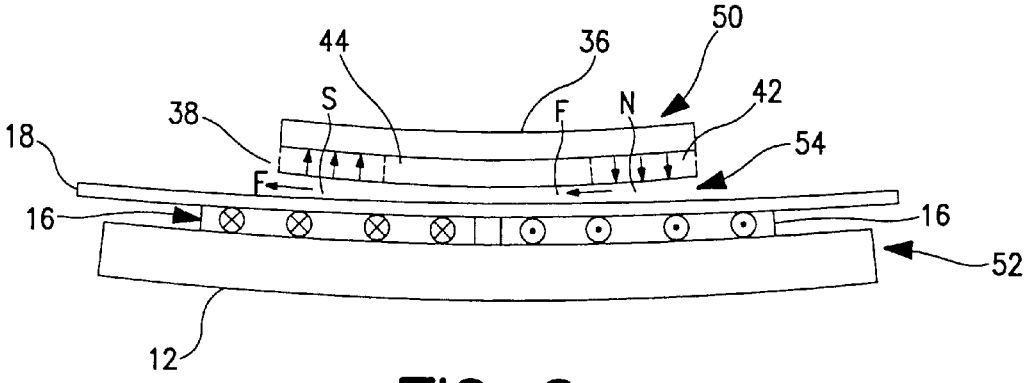
FIG. 2: is a partial sectional view of the motor assembly shown in FIG. 1 taken along lines 2—2.

Turning now to FIG. 2, there is provided a partial sectional view of the assembly of FIG. 1 wherein the orientation of the rotor 50 and the stator 52 are more particularly shown. As illustrated, the gimbal mechanism provided by the bar 24 maintains an air gap 54 between the rotor and the stator. The air gap 54 may have a constant width, or may have a width that varies with rotation of the handle, depending on the application.

In the illustrated embodiment two degrees of freedom are achieved. The degrees of freedom represent two orthogonal coordinates similar to the x and y axis in a Cartesian coordinate system, i.e. the standard θ and ϕ of spherical geometry. One degree of freedom may be considered "left to right" movement in FIG. 2, and another degree of freedom may be movement into and out of the page in FIG. 2.

Torque is created at the output of the motor, e.g. the handle 20, by selectively energizing the windings using an internal or external power supply. In the embodiment illustrated in FIG. 2, electrical current runs into and out of the page in the lower coil 16. The lower coil 16 is used for actuation left-to-right, i.e., lateral movement, producing a roll rotation direction.

In the upper coil 18, which is positioned immediately above the lower coil, electrical current runs to the left and right of the page. The coil 18 used for actuation of the motor into and out of the page. The positive electrical current in this coil travels from left-to-right in the leg of the coil shown in FIG. 2, and right to left on the far side of the coil, which is not shown in FIG. 2. The actuation for force (torque) into and out-of the page is achieved using the magnets 40,44. The into- and out-of-page motion produces a pitch rotation in a joystick application.

The angles and sizes of the coils 16,18 can be adjusted to provide different force capabilities in pitch and roll if desired. Additionally, the pitch and roll axes can be arranged at a 45-degree angle to the coils if desired. This requires a controller to mix the currents to the pair of coils to drive one axis, but may improve manufacturability by allowing the end turns to easily clear the gimbal pivots. Any angles of coils for the two axis can be used to provide any desired angles of actuation by controlling the current to each coil such that the net force produced (the vector sum of the forces) is in the desired direction. This remapping of the forces can be performed by the electronics and/or a computer and may allow a less expensive embodiment to perform a desired task. The substantially orthogonal coil arrangement is the preferred embodiment since it reduces the complexity of the control system.

The coils can be wound using standard winding techniques for copper coils. Generally it is easier to wind the coils on a flat surface. However, if a curved geometry is used, as shown in FIGS. 1 and 2, the windings may be press-fit or heated then press-fit to the desired shape. The windings may also be wound between curved forming plates (not shown), or wound directly onto a form. Also, the windings may be wound so that their positions are adjustable to allow for user adjustment or re-mapping of the motor degrees of freedom. If desired, the stator iron 12 can be formed with teeth in the form of pins and the coils can be laid in the notches between the teeth. This is useful for reducing the magnet size required, but makes manufacturing more complex.

The back iron 36 may be fabricated using laminations in order to achieve improved frequency response operation and reduce eddy current heating losses. Lamination stock of suitable thickness for high frequency response is commercially available from numerous commercial vendors. Also, the magnets 38,40,42 and 44 may be provided as permanent magnets, as shown due to the cost and performance considerations.

In operation, the permanent magnets create magnetic flux, B, which couples through the current, I, in the stator windings (or coils) of active length, L. This creates a force (or torque, if a rotational geometry is used) according to the Lorentz force law, $F=I\times L\times B, T=r\times F$, which pushes the rotor to the left if the polarity of the currents and permanent magnets are as shown.

Figure 3:
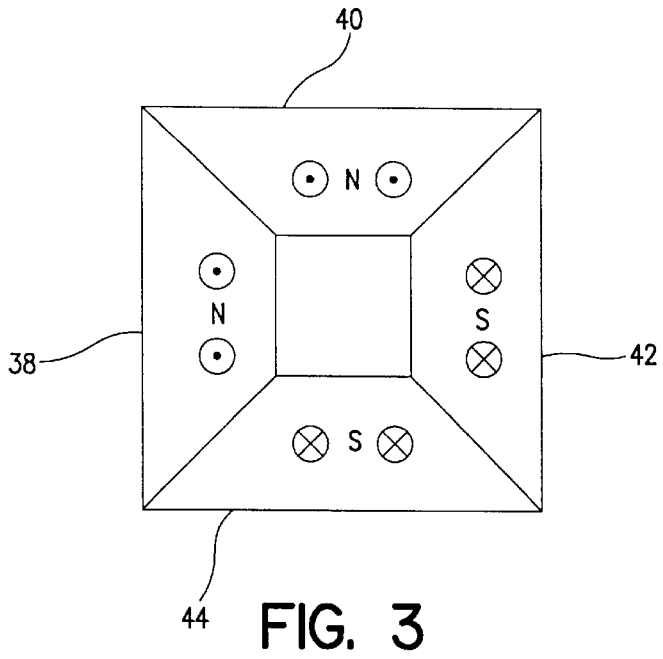
FIG. 3: is a top view of an exemplary rotor magnet assembly for a motor consistent with the invention.
Figure 4:
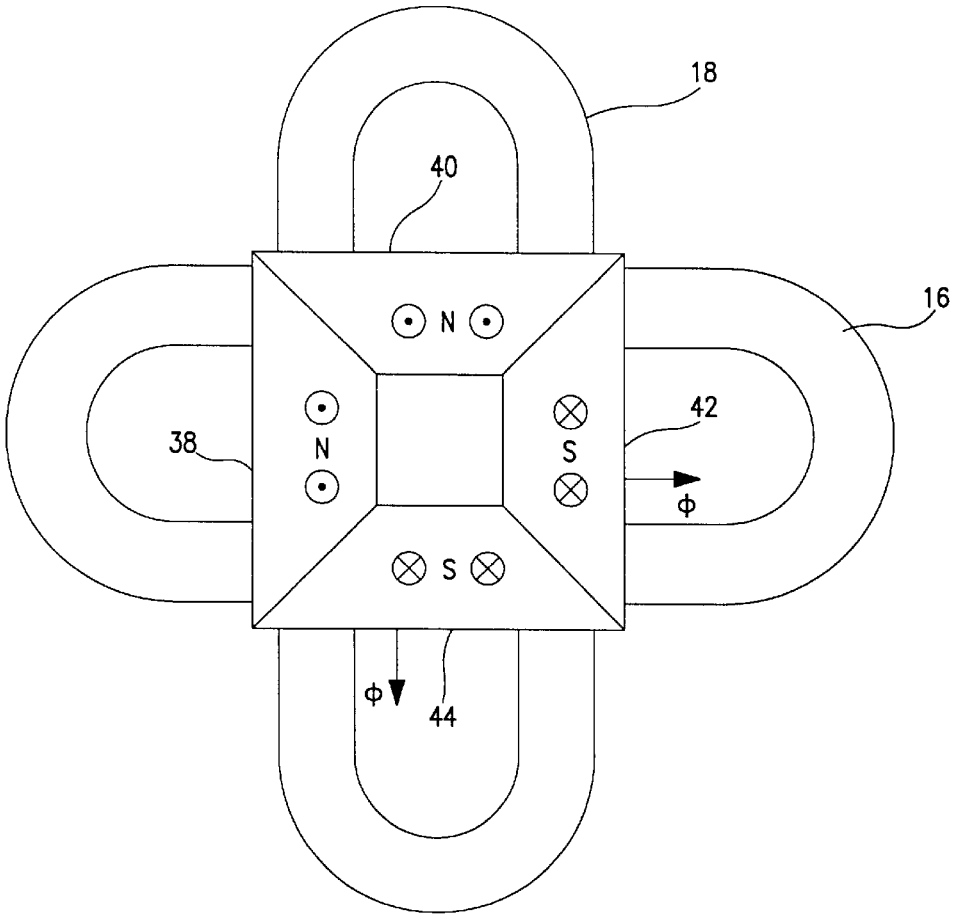
FIG. 4: is a top view of the motor magnet assembly of FIG. 1 and stator coil assembly for a motor consistent with the invention.

A top view of the complete set of rotor magnets is shown in FIG. 3. The coils 16, 18 are omitted from FIG. 3 for clarity. When the illustrated magnet array is overlaid on top of the coils 16,18, the arrangement is shown in FIG. 4. For clarity of viewing, the back irons have been omitted from FIG. 4. Four magnets utilized in this exemplary embodiment with polarities as shown.

As used herein, "N" represents the north pole and "S" represents the south pole of a magnet or electromagnet. Thus, in the illustrated embodiment first 38 and second 40 magnets forming adjacent sides of the square (or parallelogram) configuration are configured with south poles disposed adjacent the coils, i.e. north poles shown in the top view of FIG. 4. Third 42 and fourth 44 magnets forming remaining adjacent sides of the square rotor magnet configuration are configured with north poles disposed adjacent the coils, i.e. south poles shown in the top view of FIG. 4. Although use of back irons is not necessary for motor operation, the back irons 36,12 in the rotor and stator, respectively, are used to efficiently couple the magnetic flux through the magnetic circuit and create a high force in the motor.

The electrical windings are shown as single coils 16,18 that are perpendicular to each other to achieve actuation in both the lateral θ and the "fore-aft" ϕ directions. In this view, it can be seen that energization of the θ coil 18 will result in a force (torque) to the left while producing no force in the ϕ direction. This is due to illustrated unique coil and permanent magnet arrangement. Likewise, energization of the ϕ 16 coil will result in a force (torque) upward (in this view) while producing no force in the θ direction.

Figure 5:
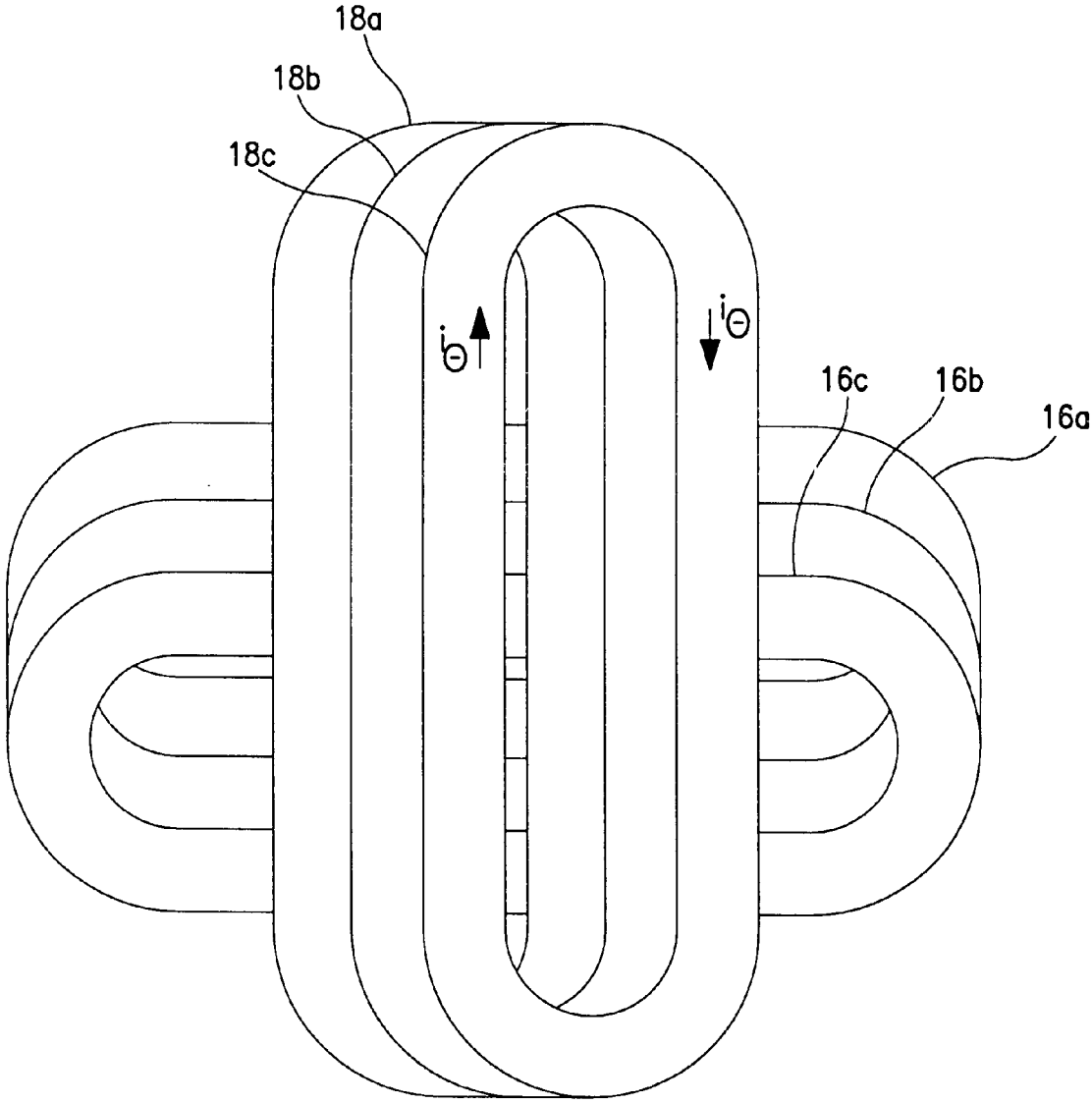
FIG. 5: is a top view of an exemplary polyphase stator coil assembly for a motor consistent with the invention.

It is to be understood that the embodiment in FIG. 4 is illustrated using a single pair of coils 16, 18 for simplicity. Those skilled in the art will recognize that it is also possible to design the motor using a 3-phase (or any other number of phases) set of windings. In FIG. 5, for example, there is shown the coil windings for a polyphase embodiment. The rotor magnet array is not shown in FIG. 5 for simplicity. In this coil arrangement, energizing only the coils that are under the magnets during rotation of the rotor can reduce the power. Many standard coil-winding options will be known to those skilled in the art. The illustrated embodiment is, however, suitable for the limited-throw case (i.e., restricted angular movement) where the right side magnet never passes over the left side coils.

Figure 6:
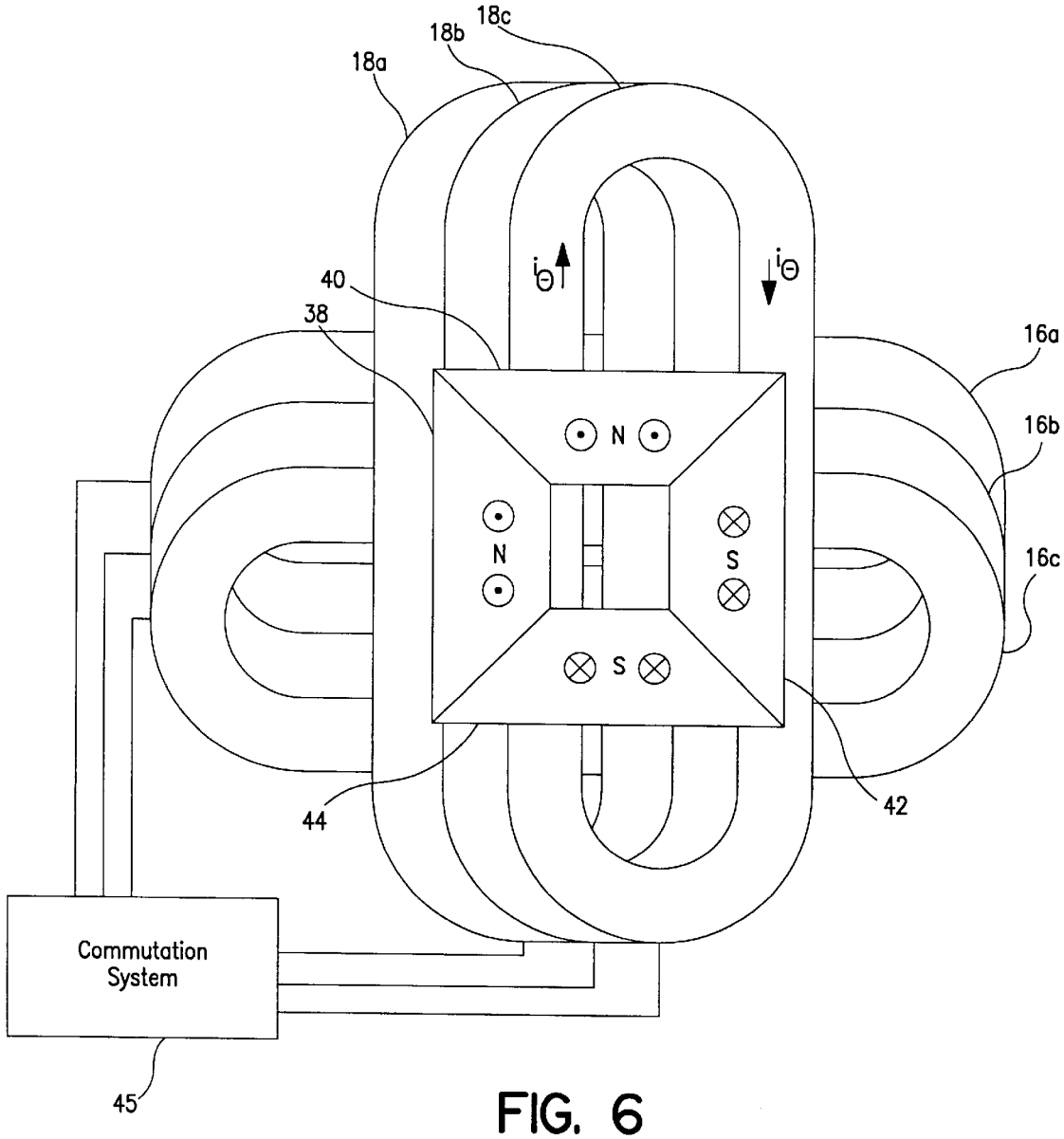
FIG. 6: is a top view of the stator coil assembly shown in FIG. 5 in position relative to the rotor magnet assembly as shown in FIG. 3.

FIG. 6 presents a view of the arrangement of FIG. 5 including the rotor magnet array. The back irons are not shown in FIG. 6 for simplicity. As shown, the conductors can be wound in the form of three independent overlapped coils 16*a*, 16*b*, 16*c* and 18*a*, 18*b*, 18*c* that can be driven with a three-phase power supply. As the handle 20 moves, a commutation system 45 (e.g., including sensors, controls, and power supply) changes the distribution of currents in the coils to provide a desired force at any stick position. This can produce a motor with an increased electrical efficiency. Due to the specific geometry of the design, the forces on the two axes are independently controlled with negligible cross talk or influence between axes.

In addition to the torques produced by the electrical current, a centering force can be obtained by forming the center of the sphere 12 to be slightly above the center of the stick (i.e. the handle 20 and shaft 22) rotation so that the closest approach occurs when the stick is centered. The inherent attraction of the magnets 38, 40, 42, 44 to the ferromagnetic sphere 12 will then produce a centering force.

Similarly, if the center of the sphere 12 is located below the pivot point then the magnetic force is destabilizing and drives the stick towards the edge. A bias in any direction or no bias can be achieved by controlling the location of the center of the sphere 12 in relation to the center of the gimbal pivot system. Similarly, arranging the gimbal so that the axes do not cross at a point allows a bias of one axis to be different than the other. More complex modifications of the curved or spherical surface are useful. For example a dimple pattern at the bottom center would help achieve the strong at center centering force that many joysticks available today have. For most applications the neutral condition is the best. In the neutral configuration all the pivot centers and sphere centers meet at a common point. Thus, as an alternative to the illustrated bar gimbal, a ball joint gimbal can be used if desired.

For small displacements, the coils 16,18 can be substantially similar, but for large displacement designs the performance is enhanced if the coils are shaped to maintain parallelism with the edges of the magnets 38, 40, 42, 44 to the greatest extent possible. For the arrangement shown, the coils 16,18 can be wound with longitude and latitude alignment for large displacements if desired.

Alternatively, the pivot points on the sphere can be rotated 45 degrees about the vertical axis while maintaining the position of the magnets 38, 40, 42, 44 and the coils 16,18 to provide a mixed axis drive. This makes more space available for the bearings and coil end turns, but requires the two coil drive control currents be properly blended to provide the desired force vector. Since the output forces for each coil are now essentially at 45 degrees to the main axes of pitch and roll and still essentially orthogonal, this control is still very easily handled by a controller with or without a mathematical look-up table.

The coils 16,18 can be wound in layers and commutated so that only those coils most suited to producing the desired forces (those under the magnets) can be activated. Another alternative is to inset the coils in slots in the ferromagnetic sphere. This can enhance the performance by increasing the magnetic flux from the permanent magnets and reducing the effective air gap. The slots then form a grid-like pattern of pins on the sphere. It is advantageous to space these pins relative to the edges of the magnets so that the magnet motion tends to cover a constant area of pins, thus minimizing the cogging. As one edge moves over new pins the other edge leaves the old pins such that the overall area remains constant. The greatest cogging force comes from the magnets seeking the lowest reluctance position, which for this design tends to be that position in which the maximum tooth areas is under the magnets, thus the design to maintain a constant area to the greatest degree possible. Cogging may not, however, be an important parameter for some configurations and control schemes.

For use as a joystick, the motor may be used in either a simulator application (in which the user controls a simulated device such as a computer game or a flight simulator) or a real control application where the user is either controlling a machine, vehicle or other such device. In addition, it will be recognized that the motor can be used for a variety of positioning tasks, for example, the motor could be used as a mirror control for precise angular control about two axis of rotation can be achieved with this motor. The control for these two applications can be arranged as conceptually shown below in block diagram form in FIGS. 7 and 8.

Figure 7:
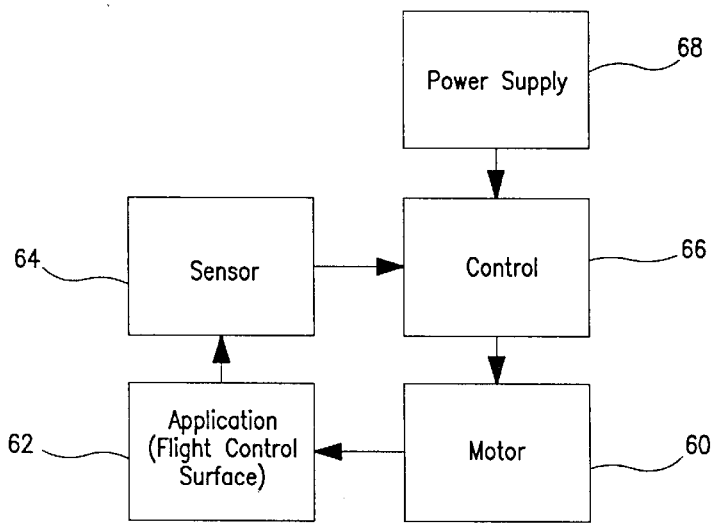
FIG. 7: illustrates in block diagram form a control scheme for actuator control application for a motor consistent with the invention.
Figure 8:
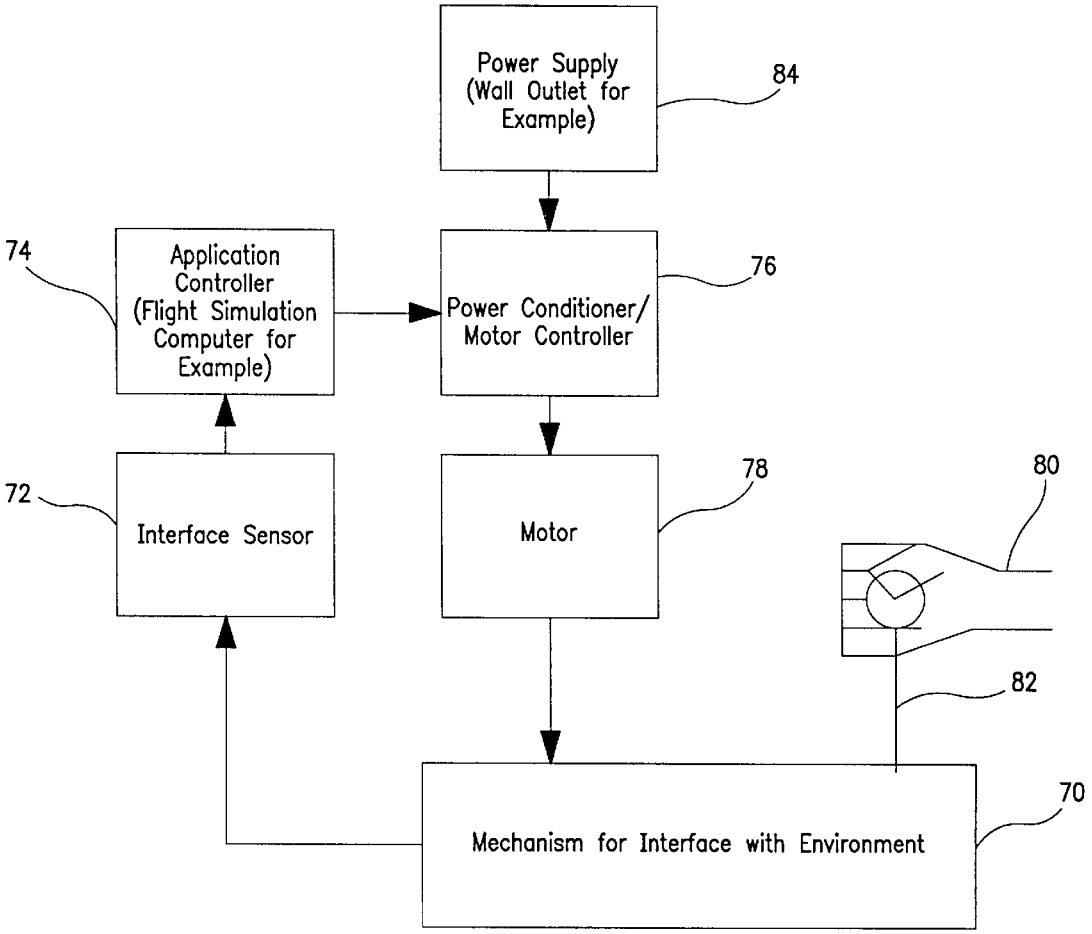
FIG. 8: illustrates in block diagram form a control scheme for a simulation control application for a motor consistent with the invention.

Turning now to now to FIG. 7 there is shown a functional block diagram identifying a control scheme for a motor consistent with the invention in an actuator application. A motor 60 consistent with the invention may include component that is actuated by a user or machine. For example, the motor 60 may control the position of a mirror, a control surface, (such as the tail of a dart or aircraft), or a robotic surgical device. The position of the component may be sensed by potentiometers, for example, and output to a control application 62 for causing real control of the apparatus. For example, the application may cause corresponding modification of an aircraft pitch and/or roll based on the motor position.

The modified position of the apparatus may be sensed by a sensor 64 and provided to a feedback control 66 for providing control of the motor 60 in dependence of the new position. Power supply 68 provides power to the entire system.

Turning now to FIG. 7, there is shown a control scheme for use of a motor 60 consistent with the invention in a simulator or generalized application including actual control of a device, vehicle, or aircraft. As shown, operator manipulation of a joy stick handle or other interface with the environment 70 is sensed by an interface sensor 72, which may include, for example, potentiometers for sensing rotational position of gimbals. The position sensed by sensor 72 is provided as an input to an application controller 74. The application controller may, for example, be a flight simulation computer running software for a simulation program. The output of the controller 74 is provided to a power conditioner/motor controller 76 which provides an output to a motor 78 consistent with the invention to energize the motor coils and provide an output force to the user 80 through the joystick handle 82 in the manner described above. The power supply 84 provides power to the entire system.

There is thus provided a motor that is capable of providing output in multiple degrees of freedom. The motor is simple and efficient in design and can be adapted for a variety of applications including joystick applications. The motor includes substantially orthogonally arranged stator coils wound thereon. A rotor including a plurality of magnets is provided adjacent the stator. The rotor may be provided at the end of an output shaft that is pivotally disposed relative to the stator for pivotal movement upon energization of the stator coils.

The embodiments described herein, however, are but some of the several which utilize this invention and are set forth here by way of illustration but not of limitation. For example, although a motor consistent with the invention can provide output in multiple degrees of freedom, would be possible to operate the motor in only one degree of freedom by providing or energizing only a single coil. Another example of use of the invention is replacement of the joystick with a mirror; the mirror can then be tilted in two degrees of freedom for scanning or alignment purposes. Also, a wide variety of gimbal arrangements may be provided for pivotally supporting the stick to maintain an air gap between the stator and rotor. It is obvious that many other embodiments, which will be readily apparent to those skilled in the art, may be made without departing materially from the spirit and scope of the invention as defined in the appended claims.

What is claimed is:

1. A method of providing force feedback to joystick handle in response to manipulation of said handle by a user, said method comprising:

providing a motor coupled to said joystick handle, said motor comprising:

a stator, said stator having an interior curved surface and first and second stator coils wound on said interior surface, said stator coils positioned substantially orthogonally to each other a rotor fixed to said handle and movably supported adjacent said stator with an air gap disposed between said rotor and said stator, said rotor at least one magnet disposed thereon and being for movable along said interior surface in directions defining at least first and second degrees of freedom;

sensing a position of said joystick; and energizing at least one of said coils based on said position to establish a said feedback force against said rotor.

2. A method according to claim 1, wherein said first degree of freedom is substantially perpendicular to wires of one of said first and second coils associated with the first degree of freedom and said second degree of freedom is substantially perpendicular to wires of the other of said first and second coils.

3. A method according to claim 1, wherein said interior curved surface defines at least a portion of a sphere.

4. A method according to claim 1, wherein said at least one magnet is a permanent magnet.

5. A method according to claim 1, wherein said rotor includes a plurality of said magnets disposed thereon, and wherein each of said plurality of magnets forms a different side of a parallelogram with first and second ones of said magnets defining a first pair of parallel sides of said parallelogram which are parallel to said first stator coil, and third and fourth ones of said magnets defining a second pair of parallel sides of said parallelogram which are parallel to said second stator coil.

6. A method according to claim 5, wherein said parallelogram is a square.

7. A method according to claim 5, wherein said first and third ones of said magnets are configured with north poles disposed adjacent said stator coils and said second and fourth ones of said magnets are configured with south poles disposed adjacent said stator coils.

8. A method according to claim 1, wherein said rotor is supported adjacent said stator by a gimbal mechanism connected to said handle and supported on said stator.

9. A method according to claim 8, wherein said gimbal mechanism is configured to establish pivot points for said handle to allow motion of said rotor in said first and second degrees for freedom, said pivot points being aligned with an equator of said curved surface.

10. A method according to claim 1, wherein said first and second degrees of freedom are adjustable by said user.

11. A method according to claim 1, wherein said curved surface is uniformly curved.

12. A motor having an output shaft movable in multiple degrees of freedom, said motor comprising:

a stator, said stator having an interior curved surface which defines at least a, portion of a sphere, and first and second stator coils wound on said interior surface, said stator coils positioned substantially orthogonally to each other;

a rotor fixed to said output shaft and movably supported adjacent said stator with an air gap disposed between said rotor and said stator, said rotor including at least one magnet disposed thereon and being movable along said interior surface in directions defining at least first and second degrees of freedom;

wherein upon energization of said first stator coil a first magnetic field is established to force said rotor in a direction in said first degree of freedom, and upon energization of said second stator coil a second magnetic field is established to force said rotor in a direction in said second degree of freedom.

13. A motor according to claim 12, wherein said first degree of freedom is substantially perpendicular to wires of one of said first and second coils associated with the first degree of freedom and said second degree of freedom is substantially perpendicular to wires of the other of said first and second coils.

14. A motor according to claim 12, wherein said interior surface is defined by a stator back iron comprising a ferromagnetic material.

15. A motor according to claim 12, wherein said curved surface is uniformly curved.

16. A motor according to claim 12, wherein said at least one magnet is a permanent magnet.

17. A motor according to claim 12, wherein said rotor includes a plurality of said magnets disposed thereon, and wherein each of said plurality of magnets forms a different side of a parallelogram with first and second ones of said magnets defining a first pair of parallel sides of said parallelogram which are substantially parallel to said first stator coil, and third and fourth ones of said magnets defining a second pair of parallel sides of said parallelogram which are substantially parallel to said second stator coil.

18. A motor according to claim 17, wherein said parallelogram is a square.

19. A motor according to claim 17, wherein said first and third ones of said magnets are configured with north poles disposed adjacent said stator coils and said second and fourth ones of said magnets are configured with south poles disposed adjacent said stator coils.

20. A motor according to claim 12, wherein said rotor is supported adjacent said stator by a gimbal mechanism connected to said output shaft and supported on a stator.

21. A motor according to claim 20, wherein said gimbal mechanism is configured to establish pivot points for said output shaft to allow motion of said rotor in said first and second degrees for freedom, said pivot points being aligned with an equator of said curved surface.

* * * * *

UNITED STATES PATENT AND TRADEMARK OFFICE

CERTIFICATE OF CORRECTION

PATENT NO. : 6,320,284 B1
DATED : November 20, 2001
INVENTOR(S) : Fontana et al.

It is certified that error appears in the above-identified patent and that said Letters Patent is hereby corrected as shown below:

Column 1,
Line 6, please insert the following:

-- STATEMENT REGARDING FEDERALLY SPONSORED RESEARCH OR DEVELOPMENT

The government has a paid-up license in this invention and the right in limited circumstances to require the patent owner to license others on reasonable terms as provided for by the terms of contract F33615-00-C-6009 awarded by U.S. Air Force. --

Signed and Sealed this

Eleventh Day of November, 2003

JAMES E. ROGAN
*Director of the United States Patent and Trademark Office*